US012594646B2

(12) United States Patent
Geissler et al.

(10) Patent No.: US 12,594,646 B2
(45) Date of Patent: Apr. 7, 2026

(54) WINDOW LOGIC FOR CONTROL OF POLISHING PROCESS

(71) Applicant: Applied Materials, Inc., Santa Clara, CA (US)

(72) Inventors: Volker Geissler, Freital (DE); Benjamin Cherian, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 367 days.

(21) Appl. No.: 18/190,770

(22) Filed: Mar. 27, 2023

(65) Prior Publication Data

US 2023/0415302 A1 Dec. 28, 2023

Related U.S. Application Data

(60) Provisional application No. 63/354,580, filed on Jun. 22, 2022.

(51) Int. Cl.
*B24B 49/04* (2006.01)
*B24B 51/00* (2006.01)

(52) U.S. Cl.
CPC ..... *B24B 49/04* (2013.01); *B24B 51/00* (2013.01)

(58) Field of Classification Search
CPC ..... B24B 37/013; B24B 51/00; B24B 49/04
See application file for complete search history.

(56) References Cited

U.S. PATENT DOCUMENTS 5,190,614 A 3/1993 Leach et al.
5,985,679 A 11/1999 Berman
6,309,276 B1 10/2001 Tsai et al.
6,383,058 B1 5/2002 Birang et al.
6,399,501 B2 6/2002 Birang et al.
(Continued)

FOREIGN PATENT DOCUMENTS

JP 2001-257187 A 9/2001
JP 2005-516383 A 6/2005
(Continued)

OTHER PUBLICATIONS

International Search Report and Written Opinion in International Appln. No. PCT/US2023/016400, mailed on Jul. 11, 2023, 12 pages.

(Continued)

*Primary Examiner* — An H Do
(74) *Attorney, Agent, or Firm* — Fish & Richardson P.C.

(57) ABSTRACT

A method of controlling a chemical mechanical polishing system includes receiving a respective time-varying test signal from an endpoint detection system for each of a plurality of test substrates, simultaneously visually displaying the plurality of time-varying test signals on a display with the plurality of time-varying test signals overlaid on each other in a graph. receiving user input selecting a box having a defined time range and defined signal value range, and receiving a selection of one from a preset group of boundary crossing logic functions to provide a selected boundary crossing logic function. During chemical mechanical polishing of a device substrate, the device substrate is monitored with the endpoint detection system to generate a time-varying signal and an endpoint determination can be based on whether the time-varying signal satisfies the selected boundary crossing logic function.

17 Claims, 7 Drawing Sheets

(56) References Cited

U.S. PATENT DOCUMENTS

| | | | | |
|---|---|---|---|---|
| 6,924,641 | B1 | 8/2005 | Hanawa et al. | |
| 6,937,915 | B1 | 8/2005 | Kistler et al. | |
| 7,018,271 | B2 | 3/2006 | Wiswesser et al. | |
| 7,764,377 | B2 | 7/2010 | Benvegnu et al. | |
| 9,221,147 | B2 * | 12/2015 | Qian | B24B 37/013 |
| 10,343,253 | B2 * | 7/2019 | Bello | B24B 37/04 |
| 2003/0082996 | A1 | 5/2003 | Fortin et al. | |
| 2003/0136684 | A1 | 7/2003 | Duboust et al. | |
| 2005/0118839 | A1 * | 6/2005 | Chen | B24B 49/12 257/E21.244 |
| 2009/0275265 | A1 | 11/2009 | Qian et al. | |
| 2015/0371912 | A1 | 12/2015 | Bello et al. | |
| 2020/0016720 | A1 | 1/2020 | Nakamura | |

FOREIGN PATENT DOCUMENTS

| | | | |
|---|---|---|---|
| JP | 2008-108940 | A | 5/2008 |
| JP | 2010-519771 | A | 6/2010 |
| KR | 10-2004-0078131 | A | 9/2004 |
| KR | 10-2014-0147146 | A | 12/2014 |
| TW | 202006816 | | 2/2020 |
| WO | WO 2008/103964 | | 8/2008 |

OTHER PUBLICATIONS

Office Action in Taiwanese Appln. No. 112111484, dated Apr. 24, 2024, 29 pages (with Machine Translation).
Office Action in Korean Appln. No. 10-2025-7001744, mailed on Sep. 3, 2025, 25 pages (with English translation).
Office Action in Japanese Appln. No. 2024-574537, mailed on Jan. 6, 2026, 5 pages (with English translation).

* cited by examiner

WINDOW LOGIC FOR CONTROL OF POLISHING PROCESS

CROSS-REFERENCE TO RELATED APPLICATIONS

This application claims priority to U.S. Provisional Patent Application Ser. No. 63/354,580, filed Jun. 22, 2022, the disclosure of which is incorporated by reference.

TECHNICAL FIELD

This disclosure relates to in-situ monitoring of chemical mechanical polishing, and in particular to detecting a polishing endpoint.

BACKGROUND

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the conductive layer remaining between the raised pattern of the insulative layer form vias, plugs, and lines that provide conductive paths between thin film circuits on the substrate. For other applications, such as oxide polishing, the filler layer is planarized, e.g., by polishing for a predetermined time period, to leave a portion of the filler layer over the nonplanar surface. In addition, planarization of the substrate surface is usually required for photolithography.

Chemical mechanical polishing (CMP) is one accepted method of planarization. This planarization method typically requires that the substrate be mounted on a carrier or polishing head. The exposed surface of the substrate is typically placed against a rotating polishing pad. The carrier head provides a controllable load on the substrate to push it against the polishing pad. An abrasive polishing slurry is typically supplied to the surface of the polishing pad.

One problem in CMP is determining whether the polishing process is complete, i.e., whether a substrate layer has been planarized to a desired flatness or thickness, or when a desired amount of material has been removed. Variations in the slurry distribution, the polishing pad condition, the relative speed between the polishing pad and the substrate, and the load on the substrate can cause variations in the material removal rate. These variations, as well as variations in the initial thickness of the substrate layer, cause variations in the time needed to reach the polishing endpoint. Therefore, the polishing endpoint usually cannot be determined merely as a function of polishing time. In some systems, the substrate is monitored in-situ during polishing, e.g., using an optical or eddy current monitoring system.

SUMMARY

Disclosed herein is a method of controlling a CMP apparatus including an in-situ monitoring system, which can function as an end-point detection system. During a polishing operation, the chemical mechanical polishing apparatus induces motion between a substrate and a polishing pad atop a platen by rotating the platen and, in some instances, the carrier head. For example, the monitoring system can be an acoustic monitoring system, a motor torque monitoring system, an eddy current monitoring system, or an optical monitoring system. The signals from the monitoring system vary with time according to the stage of the polishing process, the material exposed on the substrate surface, and the remaining thickness of the layer being polished.

The controller presents a user-interface to the operator that displays test signals received from the in-situ monitoring system over polishing of multiple test substrates. In some implementation, the user-interface permits the operator to select a boundary-crossing window logic function for the endpoint algorithm. In some implementations, the controller performs an algorithm to determine a recommended boundary-crossing window logic function for a selected logic window based on the test signals.

In one aspect, a method of controlling a chemical mechanical polishing system includes: for each respective test substrate of a plurality of test substrates, receiving a respective time-varying test signal from an endpoint detection system during chemical mechanical polishing of the respective test substrate, thus providing a plurality of time varying test signals; simultaneously visually displaying the plurality of time-varying test signals from the plurality of test substrates on a display with the plurality of time-varying test signals overlaid on each other in a graph; receiving user input selecting a box having a defined time range and defined signal value range; through a visual user interface element, receiving a selection of one from a preset group of boundary crossing logic functions to provide a selected boundary crossing logic function; during chemical mechanical polishing of a device substrate, monitoring the device substrate with the endpoint detection system to generate a time-varying signal; evaluating whether the time-varying signal in the defined time range satisfies the selected boundary crossing logic function; and basing an endpoint determination on whether the time-varying signal satisfies the selected boundary crossing logic function.

In another aspect, a method of controlling a chemical mechanical polishing system includes: for each respective test substrate of a plurality of test substrates, receiving a respective time-varying test signal from an endpoint detection system during chemical mechanical polishing of the respective test substrate, thus providing a plurality of time varying test signals; simultaneously visually displaying the plurality of time-varying test signals from the plurality of test substrates on a display with the plurality of time-varying test signals overlaid on each other in a graph; receiving user input selecting a box providing a defined time range and defined signal value range; providing the plurality of time-varying test signals and the time range and signal value range to an algorithm and identifying by the algorithm a boundary crossing logic function satisfied by the plurality of time-varying test signals in the defined time range and defined signal value range; during chemical mechanical polishing of a device substrate, monitoring the device substrate with the endpoint detection system to generate a time-varying signal; evaluating whether the time-varying signal in the defined time range satisfies the selected boundary crossing logic function; and basing an endpoint determination on whether the time-varying signal satisfies the selected boundary crossing logic function.

The method can further include generating by the algorithm an updated time range and updated signal value range. In another aspect, a computer-readable medium tangibly storing instructions that, when executed by one or more processors of a computing device, cause the computing device to perform the operations of the aspects above.

The endpoint detection method is performed after the first endpoint criteria is detected in the first time window and the second endpoint criteria is detected in the second time window for a plurality of consecutive substrates.

Particular implementations of the subject matter described in this specification can be implemented so as to realize one or more of the following technical advantages.

Wafer-to-wafer (WTW) and within-wafer (WIW) polishing uniformity may be improved. By improving setup of the endpoint detection criteria, yield may be improved. The user interface can be intuitive and visually display information needed for a user to select a region of the signal and a window logic function that will correctly detect the polishing endpoint, reducing setup time for polishing of device substrates. Recommendation of a window logic function and optimization of the window boundaries can be automated, reducing time required for analysis and reducing user error. Quality analysis can be performed on selected endpoint window logic functions. The software of existing CMP systems can be updated to include the functionality without change to machine hardware, which can increase cost effectiveness.

The details of one or more embodiments are set forth in the accompanying drawings and the description below. Other aspects, features and advantages will be apparent from the description and drawings, and from the claims.

DESCRIPTION OF DRAWINGS

In the figures, like references indicate like elements.

DETAILED DESCRIPTION

In some semiconductor chip fabrication processes, polishing of a substrate is monitored using an in-situ monitoring system in real time. The monitoring system can be based on one or more of a variety of techniques, e.g., acoustic, motor current, torque, eddy current, or optical. But in general the monitoring system generates a time-varying signal having one or more signal parameters, such as an amplitude or a frequency. When a controller determines that the signal parameters meet pre-determined criteria, the CMP apparatus ends the polishing process. In general, a user determines the endpoint criteria by trial and error experimentation.

A CMP systems that includes an in-situ monitoring system which operates as end-point detection systems monitors the time-varying signals received from the monitoring systems in real time. The CMP system evaluates the signals to detect when the signals cross a boundary of a "logic window." The "logic window" is a selection of two respective ranges along two respective axes: an axis representative of time and an axis of the parameter being monitored, e.g., signal strength of the signal from the in-situ monitoring system. The logic window can alternatively be termed 'a box,' as the region defined by the two ranges can be displayed graphically as a rectangle.

Combinations of boundaries through which the signal enters and exits the logic window are indicative of changes in the polishing process which correlate with changes in the monitored signal. Thus, as part of endpoint detection, the CMP system may configured to detect whether the signal from the in-situ monitoring system satisfies a "boundary crossing logic function." The "boundary crossing logic function" is a selection of two boundaries of the logic window, i.e., two sides of the rectangular box: one each for entry and exit of the signal. Examples of boundary crossing functions include i) entry though a top boundary and exit through a right boundary, ii) entry through a left boundary and exit through a top boundary, iii) entry through a left boundary and exit through a bottom boundary, iv) entry through a left boundary and exit through a right boundary, and iv) entry through a bottom boundary and exit through a right boundary.

To determine a set of logic windows and associated boundary crossing logic functions, the CMP system simultaneously displays multiple test signals to the user. From the displayed information, a user provides user-defined time- and signal value ranges which determine the boundaries of logic windows for subsequent substrate polishing processes. For each of the logic windows, the user provides a boundary crossing logic function. In some instances, the logic window dimensions are optimized by an algorithm stored on the controller to detect polishing activity of interest, including determining an endpoint. In some instances, the controller is configured to determine a suggested boundary crossing logic function.

Figure 1:
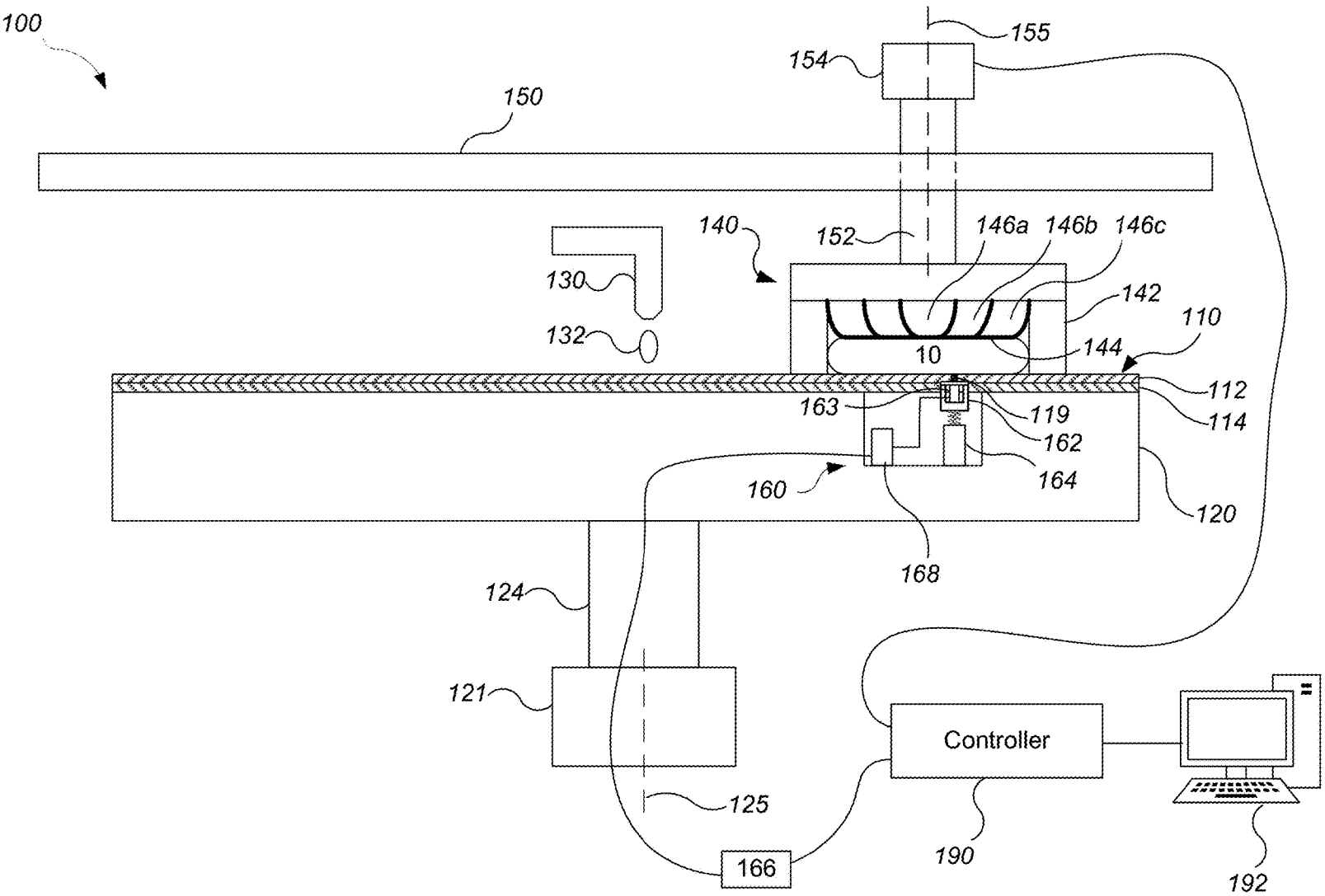
FIG. 1 illustrates a schematic cross-sectional side view of an example of a polishing apparatus.

FIG. 1 illustrates an example of a polishing system 100. The polishing system 100 includes a rotatable disk-shaped platen 120 on which a polishing pad 110 is situated. The polishing pad 110 can be a two-layer polishing pad with an outer polishing layer 112 and a softer backing layer 114. The platen is operable to rotate about an axis 125. For example, a motor 121 can turn a drive shaft 124 to rotate the platen 120.

The polishing system 100 can include a port 130 to dispense polishing liquid 132, such as abrasive slurry, onto the polishing pad 110 to the pad. The polishing apparatus can also include a polishing pad conditioner to abrade the polishing pad 110 to maintain the polishing pad 110 in a consistent abrasive state.

The polishing system 100 includes a carrier head 140. The carrier head 140 is operable to hold a substrate 10 against the polishing pad 110. The carrier head 140 can include a retaining ring 142 to retain the substrate 10 below a flexible membrane 144. The carrier head 140 can also include one or more independently controllable pressurizable chambers defined by the membrane, e.g., three chambers 146*a*-146*c*, which can apply independently controllable pressurizes to associated zones on the flexible membrane 144 and thus on the substrate 10. Although only three chambers are illustrated in FIG. 1 for ease of illustration, there could be one or two chambers, or four or more chambers, e.g., five chambers.

The carrier head 140 is suspended from a support structure 150, e.g., a carousel or track, and is connected by a drive shaft 152 to a carrier head rotation motor 154 so that the carrier head can rotate about an axis 155. Optionally each carrier head 140 can oscillate laterally, e.g., on sliders on the support structure 150, or by rotational oscillation of the carousel itself, or by sliding along the track. In typical operation, the platen is rotated about its central axis 125, and each carrier head is rotated about its central axis 155 and translated laterally across the top surface of the polishing pad.

A controller 190, such as a programmable computer, is connected to the motors 121, 154 to control the rotation rate of the platen 120 and carrier head 140. For example, each motor can include an encoder that measures the rotation rate of the associated drive shaft. A feedback control circuit, which could be in the motor itself, part of the controller, or a separate circuit, receives the measured rotation rate from the encoder and adjusts the current supplied to the motor to ensure that the rotation rate of the drive shaft matches at a rotation rate received from the controller.

The polishing system 100 includes an in-situ monitoring system 160. For example, the system 100 illustrated in FIG. 1 includes an in-situ acoustic monitoring system 160. Alternative sensors for monitoring include an eddy-current detector, an optical sensor such as a spectrograph, a motor current or torque sensor, or combinations of sensors. Continuing with the example of FIG. 1, the in-situ acoustic monitoring system 160 includes one or more acoustic signal sensors 162. Each acoustic signal sensor can be installed at one or more locations on the upper platen 120. In the particular example of FIG. 1, the in-situ acoustic monitoring system is configured to detect acoustic emissions caused by exposure of the features of an underlying layer when an overlying layer of material of the substrate 10 is removed.

In the implementation shown in FIG. 1, the acoustic monitoring system 160 includes an acoustic sensor 162 supported by the platen 120 to receive acoustic signals through the polishing pad 110 from the substrate 10. The acoustic sensor 162 can be partially or entirely in a recess 164 in the top surface of the platen 120. The portion of the polishing pad directly above the acoustic sensor 162 can include an acoustic window 119.

In the example of FIG. 1, the acoustic sensor 162 is a contact acoustic sensor having a surface connected to a portion of the polishing layer 112 and/or the acoustic window 119. The acoustic sensor 162 can be connected by circuitry 168 to a power supply and/or other signal processing electronics 166 through a rotary coupling, e.g., a mercury slip ring. The acoustic sensor 162 is stationary within the recess 164 of the platen 120 while the platen 120 rotates. This sweeps the acoustic window 119 and associated acoustic sensor 162 beneath the substrate 10 within the retaining ring 142.

Figure 2:
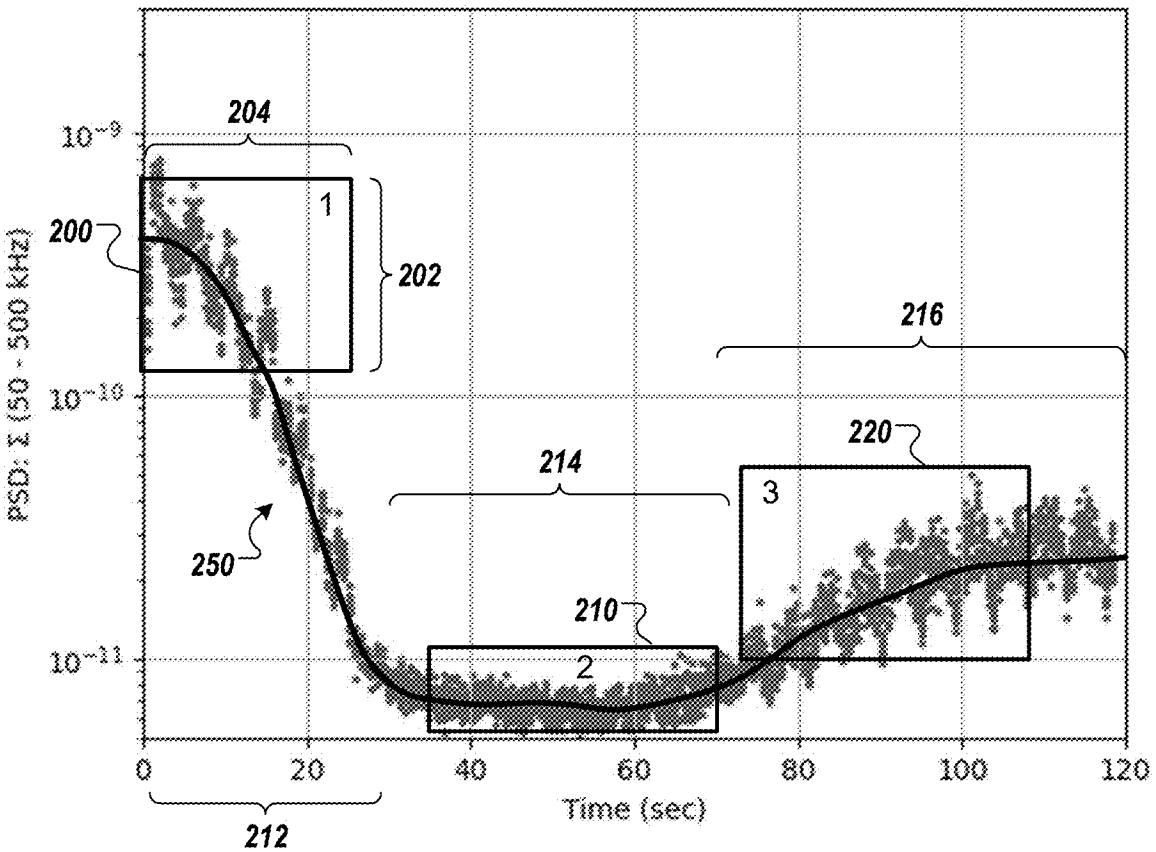
FIG. 2 is a graph depicting an exemplary test signal and three associated logic windows enclosing portions of the signal.

The acoustic sensor 162 receives an acoustic signal based on the received acoustic information from the interface between the substrate 10 and the pad 110. FIG. 2 depicts an exemplary acoustic signal 250 generated during a polishing process. The chart depicted in FIG. 2 compares the received signal value, e.g., summed power spectral density (PSD) across a frequency range, on the y-axis, against time, in seconds, on the x-axis. Other monitoring systems, such as an eddy current sensor, will produce different received signal values over time.

FIG. 2 includes data collected by the acoustic sensor 162 (dots) and a smoothed (e.g., denoised) signal (line) generated from the data. Without wishing to be bound by theory, each data point of acoustic signal 250 corresponds to a different instance in which the platen 120 sweeps the acoustic sensor 162 beneath the substrate 10. Between each data point, the platen 120 undergoes a full rotation during which the acoustic sensor 162 is not beneath the substrate 10.

Without wishing to be bound by theory, a layer transition occurs when layer topography has been removed by the system 100, and this transition can be determined from a change in the received signal. FIG. 2 includes three exemplary logic windows having different dimensions (e.g., sizes) and positions (e.g., non-overlapping ranges). Three regions 212, 214, and 216 of the signal 250 are enclosed by the three logic windows 200, 210, and 220. The logic windows 200, 210, and 220 are each enclosing separate portions of the regions 212, 214, and 216 commonly found in substrate 10 polishing corresponding to different polishing phases. As an example, logic window 200 encloses a portion of region 212 of the signal 250 during which the substrate 10 surface is being planarized to remove asperities and reduce surface roughness. As the surface roughness decreases, the acoustic energy generated by the interaction between the substrate 10 and the outer polishing layer 112 decreases and the signal received by the acoustic sensor 162 is reduced.

In the second region 214 of the signal 250 the acoustic signal 250 is substantially constant (albeit subject to noise). The polishing of a planar surface and removal of bulk material, e.g., the filler layer, may correspond to a second region 214 of the acoustic signal 250. The second region 214 continues in time until the filler layer extending above a patterned layer has been removed.

The patterned layer is composed of a different material, e.g., dielectric, than the filler layer and interacts with the polishing layer 112 surface and materials differently, the process captured by a third region 216 of the acoustic signal 250. In addition, continued polishing can create dishing, and this topology may again increase the acoustic signal. The third region 216 is not constant, e.g., can be increasing or decreasing. Determining when the signal enters the third region 216, or alternatively exits the second region 214, can provide a determination as to when the monitored polishing process has reached an end point.

It should be understood that the discussion above concerning correspondence between the portions of the signal and the polishing process are exemplary and applicable in the context of acoustic monitoring. Different signal forms can be generated depending on the process, e.g., metal or dielectric polishing, and depending on the monitoring technique, e.g., optical or eddy current monitoring.

Each of the logic windows 200, 210, and 220 are two dimensional and have four boundaries, two boundaries parallel with the y-axis and two boundaries parallel with the x-axis of FIG. 2, e.g., rectangular. The length of parallel boundaries are the same in the example of FIG. 2, but other shapes may be considered. The parallel boundaries define a signal value range and a time range for each respective logic window. For example, logic window 200 has signal value range 202 and time range 204. The signal value range 202 defines a range along the y-axis over which the signal is monitored for exceeding the boundaries of the signal value range 202. The time range 204 defines a range along the x-axis over which the signal is monitored for exceeding the boundaries of the time range 204. The time range can be an elapsed time during a polishing operation, but other measures indicative of time can be used, e.g., number of platen rotations, or a value indicative of how much of the polishing process (e.g., by percentage of time or amount removed) is expected to have been completed at the given time.

The logic windows 200, 210, and 220 define monitoring parameter ranges over which the signal 250 will be evaluated for entering or exiting the logic windows 200, 210, and 220. When the signal 250 exits logic window 200, the signal 250 exceeds or falls below the associated signal value range 202, or exceeds the time range 204. For example, the signal 250 is collected through time from 0 seconds to 120 seconds defining a directionality of the signal. As such, the signal 250 enters logic window 200 from the left, e.g., crossing the left boundary and into the time range 204. During planarization of asperities while surface roughness is reducing, the signal 250 decreases over time as asperities are removed. As such, the signal 250 exits logic window 200 from the bottom boundary and crosses out of the signal value range 202.

In the second region 214, the filler layer is being removed at a constant rate and the signal 250 remains substantially constant. As such, the signal 250 enters logic window 210 from the left boundary and exits logic window 210 from the right. In the third region 216, the filler layer is removed and the underlying layer is exposed. The signal 250 enters logic window 210 from the bottom boundary and exits from the right boundary.

During a polishing operation, the monitoring system, e.g., in-situ acoustic monitoring system 160, of the system 100 generates a signal, such as signal 250, for each substrate 10 polished. A series of polished substrates generates a series of signals, each signal corresponding to a single polishing process of a single substrate monitored by the monitoring system of the system 100. The system 100 stores the signals in data storage which can be locally connected or networked.

The system 100 includes a user interface device 192 which can be integrated with the system 100 or operated as a remote device 192 over a network, e.g., a laptop, or personal computer. The controller 190 displays data from polishing operations to a display of the user interface device 192 for viewing by the user.

For configuration of the end-point detection algorithm to be performed by the controller 190, the controller 190 displays one more test signals, such as signal 250, from substrate polishing operations. For example, the one or more test signals correspond to a manufacturing batch of substrates having similar polishing test signals.

Figure 3:
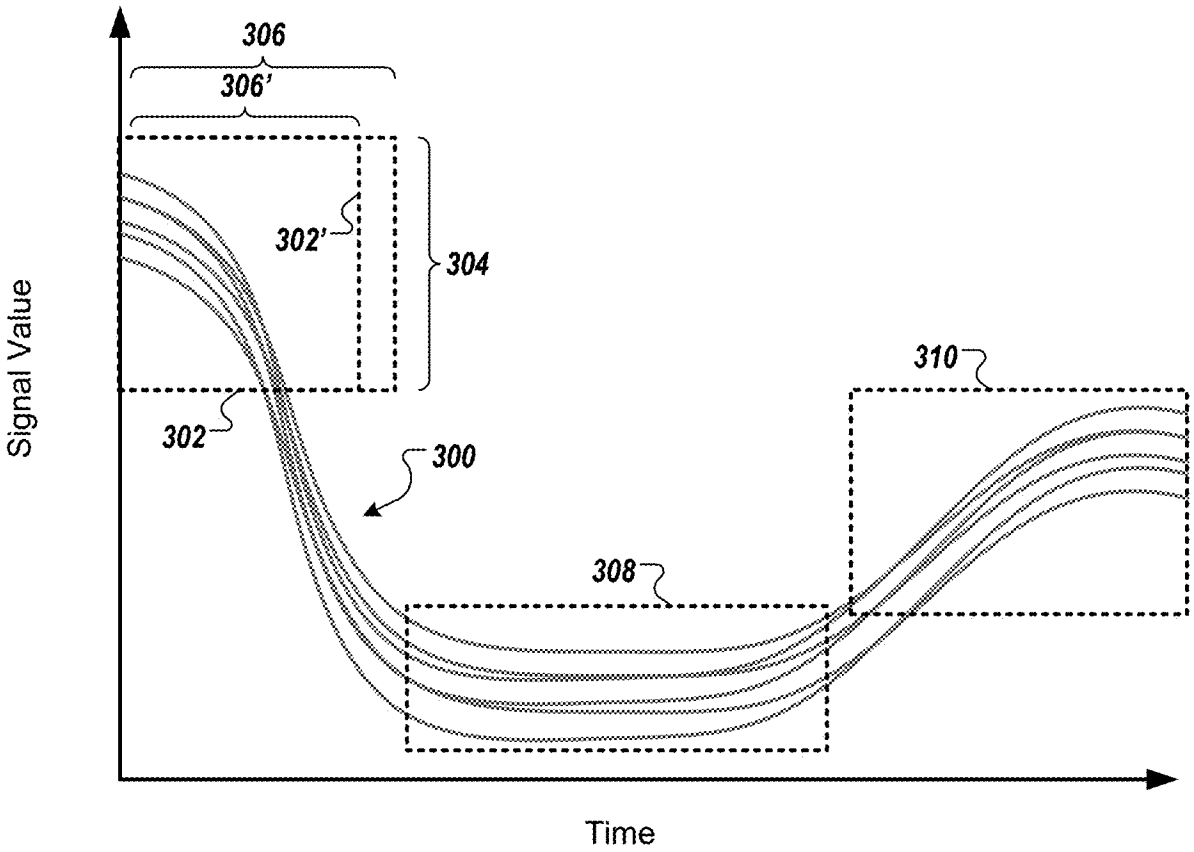
FIG. 3 is a graph depicting exemplary test signals overlaid and three associated user-defined logic windows enclosing portions of the signal.

FIG. 3 is an exemplary graph showing a group of multiple overlaid test signals 300, such as a graph which the controller 190 may display to a user on the user interface device 192. The graph compares the test signals 300 received by the monitoring system against polishing time. Overlaying the test signals 300 presents the user with a summarized view of previous test polishing operations so that the user may determine signal value- and time-ranges over which to place logic windows. The user reviews the overlaid test signals 300 and determines where to place user-defined logic windows which correspond to at least a portion of one or more regions of the signal, e.g., regions 212, 214, and 216 of the signal 250.

For example, in FIG. 3, the user can visually review the overlaid test signals 300 and enter a signal value range 304 and a time range 306 which define a logic window 302. The controller 190 receives the user-defined logic windows and stores the user-defined windows in data storage.

In some implementations, the controller 190 receives a parameter of a user-defined logic window (e.g., a signal value range, or a time range) and the controller 190 determines one or more updated parameters based on an endpoint algorithm stored in the controller 190, such as a minimization or optimization algorithm. Without wishing to be bound by theory, the endpoint algorithm functions to determine a polishing endpoint in a monitored signal based on a sequence of logic windows and boundary crossing logic functions.

Figure 4:
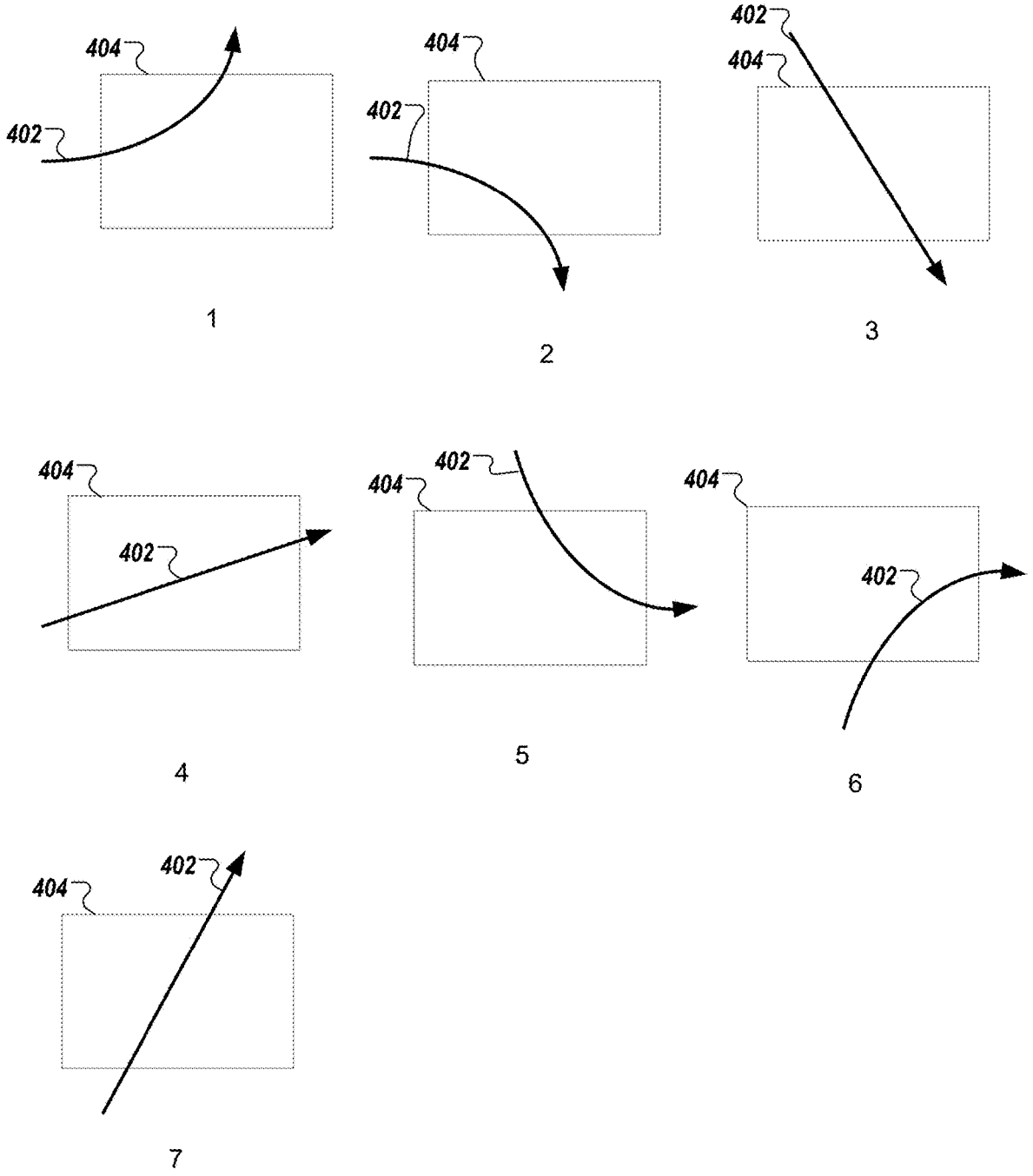
FIG. 4 illustrates a group of example boundary crossing window logic functions.

In an example of optimizing one or more logic windows, the controller 190 receives the signal value range 304 and the time range 306 which define logic window 302. The controller 190 also receives from the user interface device 192 at least one boundary crossing logic function to associate with the logic window 302. The boundary crossing logic functions correspond to combinations of boundary crossings which, in some examples, can correspond to transitions between two signal regions. FIG. 4 shows an exemplary group of boundary crossing logic functions, e.g., boundary crossings, from which a user may select. The seven examples shown in FIG. 4 are representative and non-limiting. Each element of the group consists of an arbitrary signal 402 crossing the boundaries of an arbitrary logic window 404. Examples 1 and 2 are examples of the signal 402 entering from the left boundary and exiting the top and bottom boundaries, respectively. Example 4 is an example of the signal 402 entering from the top and exiting the opposing boundary and example 4 is an example of the signal 402 entering from the left and exiting the opposing boundary. Examples 5 and 6 are examples of the signal 402 entering from the top or bottom boundary, respectively, and exiting the right boundary. Example 7 is an example of the signal 402 entering from the bottom boundary and exiting the top boundary.

Referring again to FIG. 3, the controller 190 stores the selected boundary crossing logic function corresponding with the selected user-defined logic window 302. In this manner, the user defines at least one parameter of user-defined logic windows and corresponding boundary crossing logic functions for each user-defined logic window.

The product of the signal value range 304 and the time range 306 determine a parameter area which the logic window 302 encloses. The controller 190 processes the test signals 300 and determines a number of the test signals 300 which satisfy the boundary crossing logic function associated with the logic window 302. The controller 190 changes one or both of the parameters of the logic window 302 by an amount to define an updated logic window having an area that is less than the area enclosed by logic window 302.

In the example of FIG. 3, the controller 190 changes the time range 306 of the logic window 302 to an updated time range 306' which defines an updated logic window 302'. The controller 190 determines the number of the test signals 300 which satisfy the boundary crossing logic function associated with the updated logic window 302' and compares the updated number to the original number.

If the difference in number of signals of the test signals 300 which satisfy the boundary crossing logic function associated with the updated logic window 302' is within a threshold value of the original number, the controller 190 updates the logic window 302 with the updated parameters (e.g., signal value range 304 and updated time range 302'). In some implementations, the threshold value is zero, e.g., the same number of test signals 300 satisfy the boundary crossing logic function of the updated logic window 302' as satisfy the boundary crossing logic function of the original logic window 302. Alternatively, the threshold value is a percentage of the number of test signals 300 which cross the original logic window 302, e.g., 99%, 95%, or 90%.

In some implementations, the controller 190 determines one or more suggested boundary crossing logic functions for each of the user-defined logic window 302 or updated logic window 302'. For example, the controller 190 receives the user-defined logic window 302 from the user interface device 192. Then the controller 190 determines which boundary-crossing logic function is satisfied by the largest number of test signals. For example, the controller 190 could determines that all of the test signals 300 satisfy the boundary crossing logic function shown in example 2 of FIG. 4 (e.g., left entrance and bottom exit) of the user-defined logic window 302. The controller 190 associates the boundary crossing logic function with the logic window 302.

In some implementations, the controller 190 displays the suggested boundary crossing logic function to the user interface device 192 before associating the boundary crossing logic function with the logic window 302. Optionally the controller 190 can display the number or percentage of test signals which satisfy the boundary-crossing logic function, or the controller can display multiple suggested boundary-crossing logic function and display a respective number or percentage of test signals which satisfy the respective boundary-crossing logic function. The user reviews the suggested boundary crossing logic function, and the controller 190 receives input of the user approving or declining the suggestion. The controller 190 repeats the process for additional user-defined logic windows 308 and 310 corresponding to different portions of the overlaid test signals 300.

The controller 190 stores the user-defined, updated, or both, logic windows and associated boundary crossing logic functions. The controller 190 receives a signal from the monitoring system of subsequent polishing processes of subsequent one or more substrate 10. The controller 190 compares the received signal to the sequence of logic windows and associated boundary crossing logic functions and determines if the signal satisfies the conditions of the logic windows and functions.

When the controller 190 determines that the signal satisfies the conditions and achieves the end point in the polishing process, the controller 190 commands the chemical mechanical polishing system 100 to terminate the polishing process.

Figure 5:
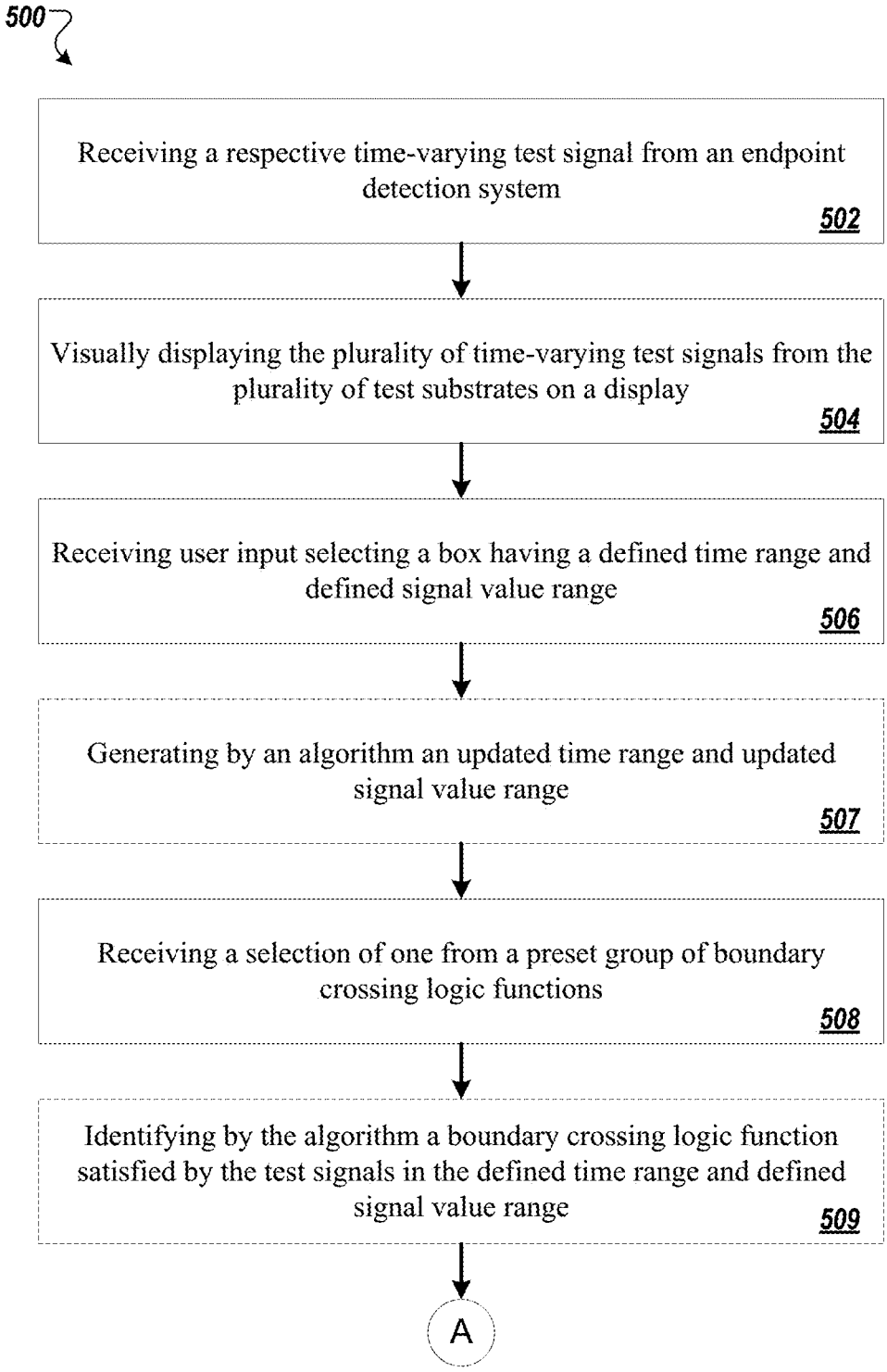
FIGS. 5 and 5A are a flow chart diagram illustrating the steps of a method of controlling a chemical mechanical polishing system.
Figure 5A:
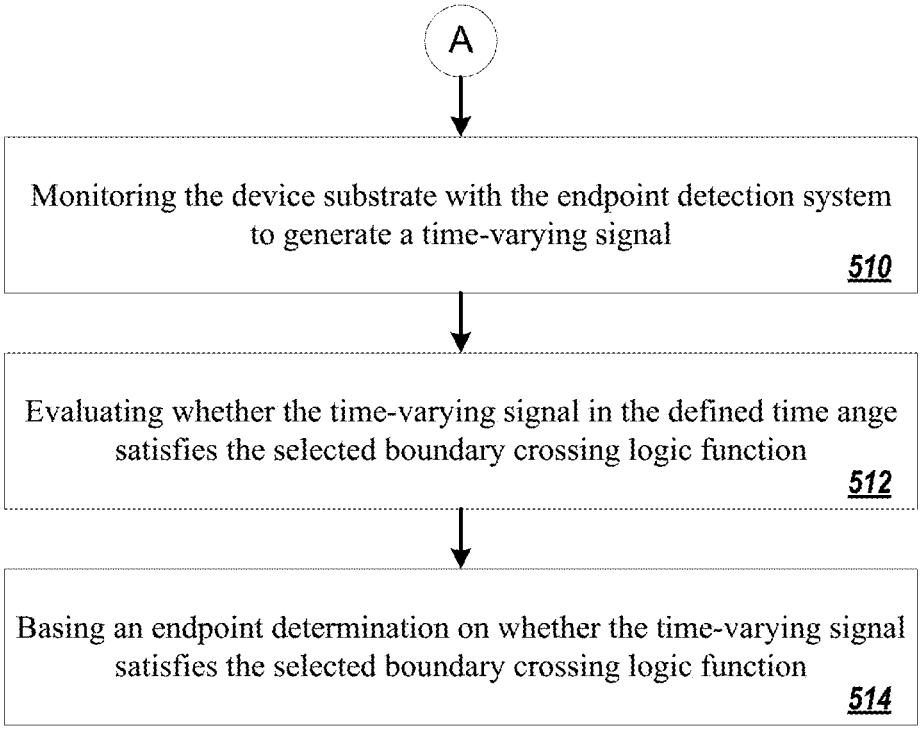

A method 500 for controlling a chemical mechanical polishing system 100 based on a window logic endpoint determination is shown in FIG. 5. The steps of the method 500 can be performed on a controller of a system 100, such as controller 190, or on an external device, such as a networked computing device. In step 502, the controller 190 receives substrate polishing test signals from a source, such as a data file, user input, or from historical measurements of substrate 10 polishing processes performed with the system 100. Each test signal is a time-varying series of data represents a polishing process of a substrate based on received measurements from an in-situ monitoring system, such as acoustic monitoring system 160. Each time-varying test signal corresponds with a unique substrate polishing process.

In step 504, the controller 190 displays a group of test signals to a user. The controller 190 visually displays more than one test signal overlain on a display to the user (as shown in FIG. 3). In some examples, the user can select one or multiple test signals for comparison. In some implementations, the controller 190 displays a portion of the test signals received in step 502, or alternatively, the controller 190 displays the totality of stored test signals.

In step 506, the controller 190 receives user input selecting parameter ranges for one or more parameters of one or more logic windows. For example, the controller 190 receives one or more logic window dimensions, e.g., heights, widths, or both, for one or more logic windows corresponding to ranges of time- or amplitude signal values. In some implementations, the logic windows correspond to a region of the test signal, such as regions 212, 214, and 216, or a portion of a region.

In optional step 507, the controller 190 generates an updated time- and signal value range by processing the parameters of the logic window through an algorithm. The controller 190 receives a parameter of a user-defined logic window (e.g., a signal value range, or a time range) and determines a number of the test signals, such as test signals 300, having at least a portion of the test signals enclosed by the user-defined logic window. The controller 190 changes one or both of the logic window parameters by an amount to define an updated logic window. The controller 190 determines a portion of the tests signals which satisfy the associated boundary crossing logic functions and compares the updated number to the original number. If the difference in number of signals crossing the updated logic window is within a threshold value, the controller 190 updates the logic window with the updated parameters.

In step 508, the controller 190 receives user input selecting one from a preset group of boundary crossing logic functions, each user input corresponding with a single logic window. For example, in a signal having three user-defined logic windows the controller receives three boundary crossing logic functions, one for each of the user-defined logic windows. The logic windows correspond to combinations of entrance and exit criteria. In some implementations, the controller 190 receives a sequence of boundary crossing logic functions to control the polishing parameter.

In optional step 509, the controller 190 identifies a boundary crossing logic function which is satisfied by the test signals within the time- and signal value range. The controller 190 processes the test signals with the algorithm and determines which one of the preset group of boundary crossing logic functions the test signals satisfy. The algorithm returns the boundary crossing logic function which is satisfied by the largest number of test signals. In some implementations, the controller 190 associates the determined boundary crossing logic function with the logic window. In some implementations, the controller 190 displays the suggested boundary crossing logic function to the user interface device for user review.

In step 510, the controller 190 monitors the polishing process with the endpoint detection system to generate a time-varying signal based on data collected of the substrate 10 being polished on the system 100. In general, the endpoint detection system is any detection system capable of receiving signals indicative of the polishing process, and non-limiting examples can include any described herein.

In step 512, once the endpoint detection algorithm has been configured and the polishing system is used for polishing of a substrate, e.g., a device substrate being used for fabrication of integrated circuits, the in-situ monitoring system generates a polishing signal during polishing. The controller 190 evaluates whether the polishing signal satisfies the selected boundary crossing logic function for each of the user-defined logic windows in sequence. When the polishing signal is within both the time-range and the signal value-range, the conditions for the logic window are met. The controller 190 monitors the polishing signal and determines when the conditions are no longer satisfied, e.g., when a signal value range or a time value range of the logic window is exceeded.

In step 514, the controller 190 bases an endpoint determination on whether the time-varying polishing signal satisfies one or more of the selected boundary crossing logic functions for the user-defined logic windows. The controller 190 determines if the boundary crossing logic function monitored by the controller 190 matches the corresponding boundary crossing correlated with the user-defined logic window and stored in data storage.

Figure 6:
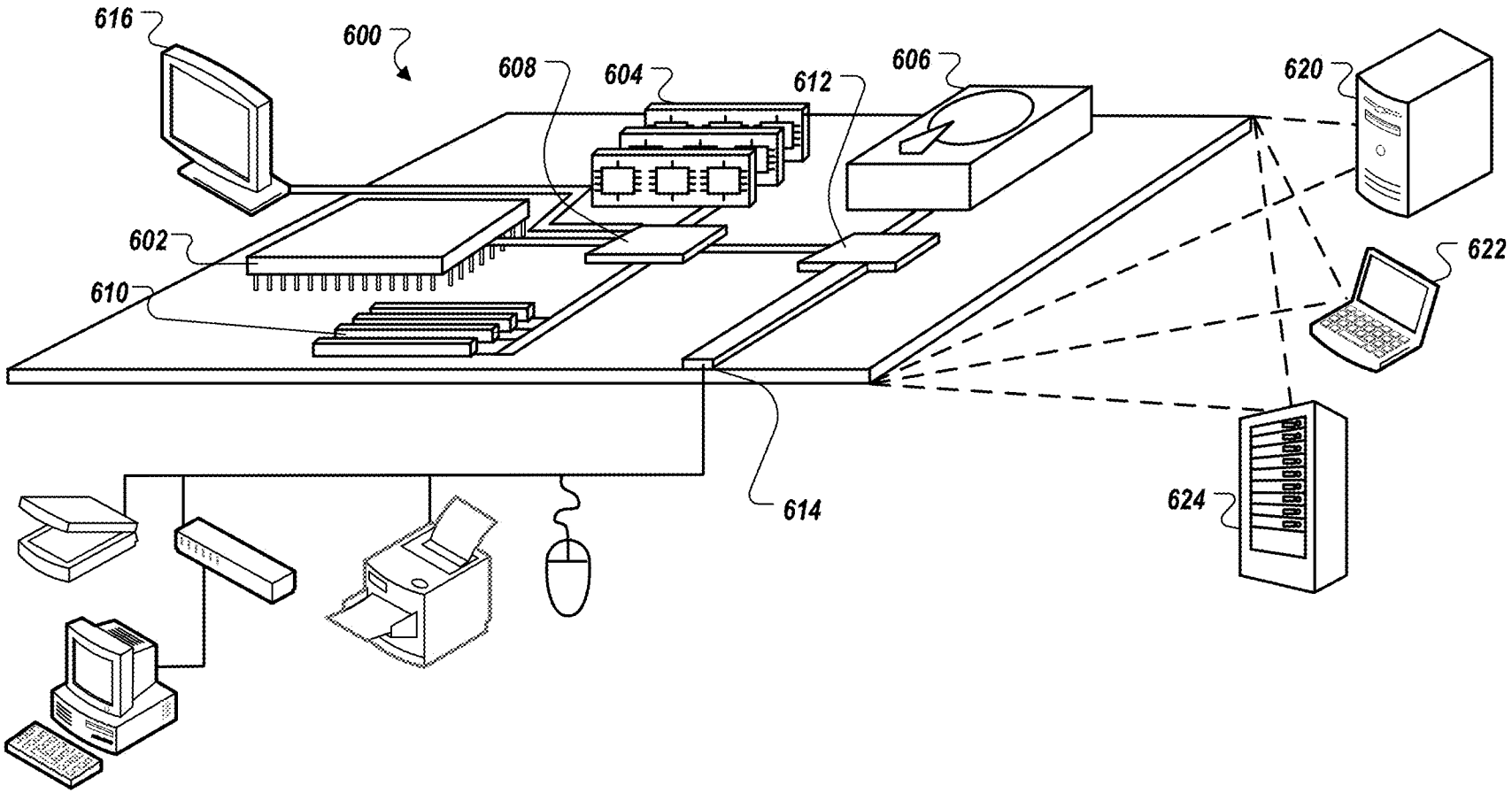
FIG. 6 illustrates a schematic diagram of examples of computing devices.

As noted previously, the systems and methods disclosed above utilize data processing apparatus to implement aspects of the method of controlling a chemical mechanical polishing system described. FIG. 6 shows an example of a computing device 600 that can be used as data processing apparatuses to implement the techniques described here. The computing device 600 is intended to represent various forms of digital computers, such as laptops, desktops, workstations, personal digital assistants, servers, blade servers, mainframes, and other appropriate computers. The components shown here, their connections and relationships, and their functions, are meant to be examples only, and are not meant to be limiting.

The computing device 600 includes a processor 602, a memory 604, a storage device 606, a high-speed interface 608 connecting to the memory 604 and multiple high-speed expansion ports 610, and a low-speed interface 612 connecting to a low-speed expansion port 614 and the storage device 606.

The processor 602 can process instructions for execution within the computing device 600, including instructions stored in the memory 604 or on the storage device 606 to display graphical information for a GUI on an external input/output device, such as a display 616 coupled to the high-speed interface 608. In other implementations, multiple processors and/or multiple buses may be used, as appropriate, along with multiple memories and types of memory.

The memory 604 stores information within the computing device 600. In some implementations, the memory 604 is a volatile memory unit or units. In some implementations, the memory 604 is a non-volatile memory unit or units. The memory 604 may also be another form of computer-readable medium, such as a magnetic or optical disk.

The storage device 606 is capable of providing mass storage for the computing device 600. In some implementations, the storage device 606 may be or contain a computer-readable medium, such as a floppy disk device, a hard disk device, an optical disk device, or a tape device, a flash memory or other similar solid state memory device, or an array of devices, including devices in a storage area network or other configurations. Instructions can be stored in an information carrier. The instructions, when executed by one or more processing devices (for example, processor 602), perform one or more methods, such as those described above.

The high-speed interface 608 manages bandwidth-intensive operations for the computing device 600, while the low-speed interface 612 manages lower bandwidth-intensive operations. Such allocation of functions is an example only. In some implementations, the high-speed interface 608 is coupled to the memory 604, the display 616 (e.g., through a graphics processor or accelerator), and to the high-speed expansion ports 610, which may accept various expansion cards (not shown). In the implementation, the low-speed interface 612 is coupled to the storage device 606 and the low-speed expansion port 614. The low-speed expansion port 614, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

The computing device 600 may be implemented in a number of different forms, as shown in the figure. For example, it may be implemented as a standard server 620, or multiple times in a group of such servers. In addition, it may be implemented in a personal computer such as a laptop computer 622. It may also be implemented as part of a rack server system 624.

These computer programs (also known as programs, software, software applications or code) include machine instructions for a programmable processor, and can be implemented in a high-level procedural and/or object-oriented programming language, and/or in assembly/machine language. As used herein, the terms machine-readable medium and computer-readable medium refer to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term machine-readable signal refers to any signal used to provide machine instructions and/or data to a programmable processor.

To provide for interaction with a user, the systems and techniques described here can be implemented on a computer having a display device (e.g., an OLED (organic light emitting diode) display or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here can be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network (LAN), a wide area network (WAN), and the Internet.

While this specification contains many details, these should not be construed as limitations on the scope of what may be claimed, but rather as descriptions of features specific to particular examples. Certain features that are described in this specification in the context of separate implementations can also be combined. Conversely, various features that are described in the context of a single implementation can also be implemented in multiple embodiments separately or in any suitable subcombination.

A number of implementations have been described. Nevertheless, it will be understood that various modifications may be made without departing from the spirit and scope of the invention. Accordingly, other implementations are within the scope of the following claims.

What is claimed is:

1. A method of controlling a chemical mechanical polishing system, comprising:

for each respective test substrate of a plurality of test substrates, receiving a respective time-varying test signal from an endpoint detection system during chemical mechanical polishing of the respective test substrate, thus providing a plurality of time-varying test signals;

simultaneously visually displaying the plurality of time-varying test signals from the plurality of test substrates on a display with the plurality of time-varying test signals overlaid on each other in a graph;

receiving user input selecting a box having a defined time range and defined signal value range;

through a visual user interface element, receiving a selection of one from a preset group of boundary crossing logic functions to provide a selected boundary crossing logic function;

during chemical mechanical polishing of a device substrate, monitoring the device substrate with the endpoint detection system to generate a time-varying signal;

evaluating whether the time-varying signal in the defined time range satisfies the selected boundary crossing logic function;

determining an endpoint based on whether the time-varying signal satisfies the selected boundary crossing logic function; and halting the chemical mechanical polishing of the device substrate using the endpoint.

2. The method of claim 1, wherein the preset group of boundary crossing logic functions includes i) entry through a left boundary and exit through a top boundary, ii) entry though a top boundary and exit through a bottom boundary, iii) entry though a top boundary and exit through a right boundary, iv) entry through a left boundary and exit through a bottom boundary, v) entry through a left boundary and exit through a right boundary, vi) entry through a bottom boundary and exit through a right boundary, and vii) entry though a bottom boundary and exit through a top boundary.

3. The method of claim 1, comprising:

receiving user input selecting a plurality of boxes with each respective box defined by a respective time range and respective signal value range; and through a visual user interface element, for each respective box receiving a selection of one from the preset group of boundary crossing logic functions to provide a respective selected boundary crossing logic function for the respective box.

4. The method of claim 3, comprising:

for each respective box, evaluating whether the time-varying signal in the respective time range and respective signal value range satisfies the respective selected boundary crossing logic function for the respective box; and determining the endpoint based on whether the time-varying signal satisfies the respective selected boundary crossing logic functions of the respective boxes.

5. A method of controlling a chemical mechanical polishing system, comprising:

for each respective test substrate of a plurality of test substrates, receiving a respective time-varying test signal from an endpoint detection system during chemical mechanical polishing of the respective test substrate, thus providing a plurality of time-varying test signals;

simultaneously visually displaying the plurality of time-varying test signals from the plurality of test substrates on a display with the plurality of time-varying test signals overlaid on each other in a graph;

receiving user input selecting a box providing a defined time range and defined signal value range;

providing the plurality of time-varying test signals and the defined time range and defined signal value range to an algorithm and identifying by the algorithm a boundary crossing logic function in the defined time range and defined signal value range;

during chemical mechanical polishing of a device substrate, monitoring the device substrate with the endpoint detection system to generate a time-varying signal;

evaluating whether the time-varying signal in the defined time range satisfies the identified boundary crossing logic function;

determining an endpoint based on whether the time-varying signal satisfies the identified boundary crossing logic function; and halting the chemical mechanical polishing of the device substrate using the endpoint.

6. The method of claim 5, wherein the identified boundary crossing logic function is identified from a preset group of boundary crossing logic functions which includes i) entry through a left boundary and exit through a top boundary, ii) entry though a top boundary and exit through a bottom boundary, iii) entry though a top boundary and exit through a right boundary, iv) entry through a left boundary and exit through a bottom boundary, v) entry through a left boundary and exit through a right boundary, vi) entry through a bottom boundary and exit through a right boundary, and vii) entry though a bottom boundary and exit through a top boundary.

7. The method of claim 6, wherein identifying by the algorithm the boundary crossing logic function comprises determining which boundary crossing logic function from the preset group of boundary crossing logic functions is satisfied by a largest number of the plurality of time-varying test signals.

8. The method of claim 6, wherein identifying by the algorithm the boundary crossing logic function comprises determining which boundary crossing logic function from the preset group of boundary crossing logic functions is satisfied by the plurality of time-varying test signals.

9. The method of claim 5, comprising receiving user input confirming selection of the boundary crossing logic function identified by the algorithm.

10. The method of claim 5, further comprising generating by the algorithm an updated time range and updated signal value range.

11. A method of controlling a chemical mechanical polishing system, comprising:

for each respective test substrate of a plurality of test substrates, receiving a respective time-varying test signal from an endpoint detection system during chemical mechanical polishing of the respective test substrate, thus providing a plurality of time-varying test signals;

simultaneously visually displaying the plurality of time-varying test signals from the plurality of test substrates on a display with the plurality of time-varying test signals overlaid on each other in a graph;

receiving user input selecting an initial box providing a defined time range and defined signal value range;

through a visual user interface element, receiving a selection of one from a preset group of boundary crossing logic functions to provide a selected boundary crossing logic function;

providing the plurality of time-varying test signals and the defined time range and defined signal value range to an algorithm and identifying by the algorithm an updated time range and/or an updated signal value range;

during chemical mechanical polishing of a device substrate, monitoring the device substrate with the endpoint detection system to generate a time-varying signal;

evaluating whether the time-varying signal in the updated time range satisfies the identified boundary crossing logic function;

determining an endpoint based on whether the time-varying signal satisfies the identified boundary crossing logic function; and halting the chemical mechanical polishing of the device substrate using the endpoint.

12. The method of claim 11, wherein identifying the updated time range and/or the updated signal value range by the algorithm comprises identifying the updated time range and/or the updated signal value range for which all of the plurality of time-varying test signals satisfy the boundary crossing logic function.

13. The method of claim 12, wherein identifying the updated time range and/or the updated signal value range by the algorithm comprises identifying a minimum time range and/or a minimum updated signal value range for which all of the plurality of time-varying test signals satisfy the boundary crossing logic function.

14. A computer-readable medium tangibly storing instructions that, when executed by one or more processors of a computing device, cause the one or more processors to perform operations comprising:

for each respective test substrate of a plurality of test substrates, receiving a respective time-varying test signal from an endpoint detection system during chemical mechanical polishing of the respective test substrate, thus providing a plurality of time varying test signals;

simultaneously visually displaying the plurality of time-varying test signals from the plurality of test substrates on a display with the plurality of time-varying test signals overlaid on each other in a graph;

receiving user input selecting a box having a defined time range and defined signal value range; and through a visual user interface element, receiving a selection of one from a preset group of boundary crossing logic functions to provide a selected boundary crossing logic function;

providing the plurality of time-varying test signals and the defined time range and defined signal value range to an algorithm and identifying by the algorithm an updated time range and/or an updated signal value range;

during chemical mechanical polishing of a device substrate, monitoring the device substrate with the endpoint detection system to generate a time-varying signal;

evaluating whether the time-varying signal in the updated time range satisfies the identified boundary crossing logic function;

determining an endpoint based on whether the time-varying signal satisfies the selected boundary crossing logic function; and halting the chemical mechanical polishing of the device substrate using the endpoint.

15. The computer-readable medium of claim 14, wherein the identified boundary crossing logic function is identified from a preset group of boundary crossing logic functions which includes i) entry through a left boundary and exit through a top boundary, ii) entry though a top boundary and exit through a bottom boundary, iii) entry though a top boundary and exit through a right boundary, iv) entry through a left boundary and exit through a bottom boundary, v) entry through a left boundary and exit through a right boundary, vi) entry through a bottom boundary and exit through a right boundary, and vii) entry though a bottom boundary and exit through a top boundary.

16. The computer-readable medium of claim 15, wherein the operations comprise:

for each respective box, evaluating whether the time-varying signal in the respective time range and respective signal value range satisfies the respective selected boundary crossing logic function for the respective box.

17. The computer-readable medium of claim 14, wherein the operations comprise:

receiving user input selecting a plurality of boxes with each respective box defined by a respective time range and respective signal value range; and through a visual user interface element, for each respective box receiving a selection of one from the preset group of boundary crossing logic functions to provide a respective selected boundary crossing logic function for the respective box.

* * * * *